United States Patent [19]

Lasker

[11] 4,096,555

[45] Jun. 20, 1978

[54] LIGHTING FIXTURES

[75] Inventor: Martin L. Lasker, Edison, N.J.

[73] Assignee: Wylain, Inc., Dallas, Tex.

[21] Appl. No.: 736,317

[22] Filed: Oct. 28, 1976

[51] Int. Cl.[2] ..... F21V 13/04

[52] U.S. Cl. ..... 362/302; 362/296; 362/342

[58] Field of Search ..... 240/81 LD, 44.1, 41.35 D, 240/25; 362/290, 291, 292, 296, 301, 302, 304, 342

[56] References Cited

U.S. PATENT DOCUMENTS

| | | | |
|---|---|---|---|
| 2,185,694 | 1/1940 | Noe | 240/81 LD |
| 2,198,014 | 4/1940 | Ott | 240/41.35 D |
| 2,899,543 | 8/1959 | Rasmussen | 240/81 LD |
| 3,115,310 | 12/1963 | Hofman | 240/81 LD |
| 3,593,014 | 7/1971 | Vesely | 240/41.1 |
| 3,836,767 | 9/1974 | Lasker | 240/25 |
| 4,001,575 | 1/1977 | Sullivan | 240/81 LD |
| 4,007,365 | 2/1977 | Stempfle | 240/44.1 |

*Primary Examiner*—Verlin R. Pendegrass
*Assistant Examiner*—Donald P. Walsh
*Attorney, Agent, or Firm*—Lane, Aitken, Dunner & Ziems

[57] ABSTRACT

In a lighting fixture, glare-free uniform illumination is achieved by means of a plurality of nested generally frusto-conical reflectors surrounding the light source of the fixture. The reflectors are shaped and positioned relative to one another and to the light source to concentrate light in the range of 65 to 71 degrees from downward vertical and to cause the intensity of the light to progressively decrease as the angle from downward vertical decreases from 65 degrees toward zero. The projected light from the fixture is concentrated in the 65 to 71 degree range from downward vertical in part by light radiated from the source at near horizontal and higher angles being doubly reflected between the frusto-conical reflectors and then projected in the high angle range. The reflectors are positioned relative to one another, to the light source and to baffles, to cut off any light from being projected at an angle from downward vertical greater than 75 degrees. The frusto-conical reflectors are mounted on three vertically extending rods surrounding the light source to provide an inexpensive reflector assembly construction.

40 Claims, 10 Drawing Figures

LIGHTING FIXTURES

BACKGROUND OF THE INVENTION

This invention relates to lighting fixtures and more particularly to lighting fixtures of the luminaire outdoor type with reflecting systems designed to produce an even distribution of light over a broad illuminated area without glare.

The efficiency of lighting fixtures is popularly measured by the lamp lumens emitted per unit of power consumption. However, this is an inaccurate measurement of the actual efficiency of the lighting fixture in achieving its primary function of providing visibility. The only true measurement of efficiency of a fixture is the level of visibility that it produces relative to the amount of energy it consumes. Foot candle levels, while being important, are hardly an accurate indication of visibility of an illuminated area. Glare from a conventional lighting fixture can cut visibility as much as 40 percent. In terms of energy consumption, this means that it is possible to produce the same level of visibility in glare-free luminaires with 250 watt lamps as with an equal number of 400 watt lamps in high-glare units. Another factor of prime importance to the degree of visibility achieved by a lighting fixture is the uniformity of illumination provided by the fixture. The reason uniformity of illumination is important to visibility is that a given area illuminated with a given low intensity adjacent to an area illuminated with high intensity will be perceived as being much darker and much less visible to the human eye than if the given area and the areas adjacent thereto are uniformly illuminated with the same given low intensity. The human eye through the opening and closing of the iris can adjust to different levels of uniform illumination across an extremely wide range. It cannot, however, account for differences in nonuniformity of light on an illuminated surface. Similarly, it cannot adjust to glare. For these reasons, a lighting fixture which provides uniform illumination without glare can much more efficiently achieve the primary function of providing visibility than a lighting fixture which does not provide uniform illumination or which provides illumination with glare.

In order to achieve uniform illumination without glare, the inventor of the present invention developed the lighting fixtures disclosed in U.S. Pat. No. 3,836,767 and in U.S. Pat. No. 3,651,320. Both of these fixtures achieve the effect of producing uniform illumination over the illuminated area and a cutoff of light rays projected above a selected cutoff angle to eliminate glare. The present invention provides another fixture which more efficiently provides uniform illumination without glare. Moreover, the lighting fixture of the present invention provides the glare-free uniform illumination with an entirely different kind of reflector system than the fixtures of the two prior patents mentioned above and, therefore, presents an entirely different appearance. The fixture thus provides the architect with another choice and additional variety of lighting fixtures to achieve the desired effect of glare-free uniform illumination.

SUMMARY OF THE PRESENT INVENTION

In accordance with the present invention, glare-free uniform illumination is achieved by means of a lighting fixture having a plurality of nested frustoconical reflectors which are shaped and positioned relative to one another and to the lamp of the fixture to concentrate light in a selected high angle range from downward vertical, preferably 65° to 71°. The concentration of light in the high angle range is achieved in large part by light radiated near horizontal and higher angles being doubly reflected between the frustoconical reflectors and then projected in the high angle range. In addition, the reflectors are positioned relative to one another and relative to baffling elements to prevent any light from being radiated above a selected cutoff angle from vertical downward. The cutoff angle is between 90° and the high angle range and preferably is just above the high angle range at 75°. The reflectors are also shaped and arranged to cause the light to progressively decrease from the high angle range down to downward vertical so as to achieve the uniform illumination effect. Thus, the fixture provides illumination over a broad area with uniformity and without glare. The fixture is mounted by a light transmitting enclosure shaped to define vertical extending ribs in order to diffuse the light horizontally but not vertically.

The reflectors are of simple construction mounted on a simple rod supporting assembly thus making the fixture inespensive to manufacture. Yet, the overall appearance of the fixture is highly pleasing and architecturally desirable.

BRIEF DESCRIPTION OF THE DRAWINGS

FIG. 8 is a view in section of a modified reflector system in accordance with the present invention to achieve asymmetrical lighting for roadway applications and the like;

DESCRIPTION OF THE PREFERRED EMBODIMENTS

Figure 1:
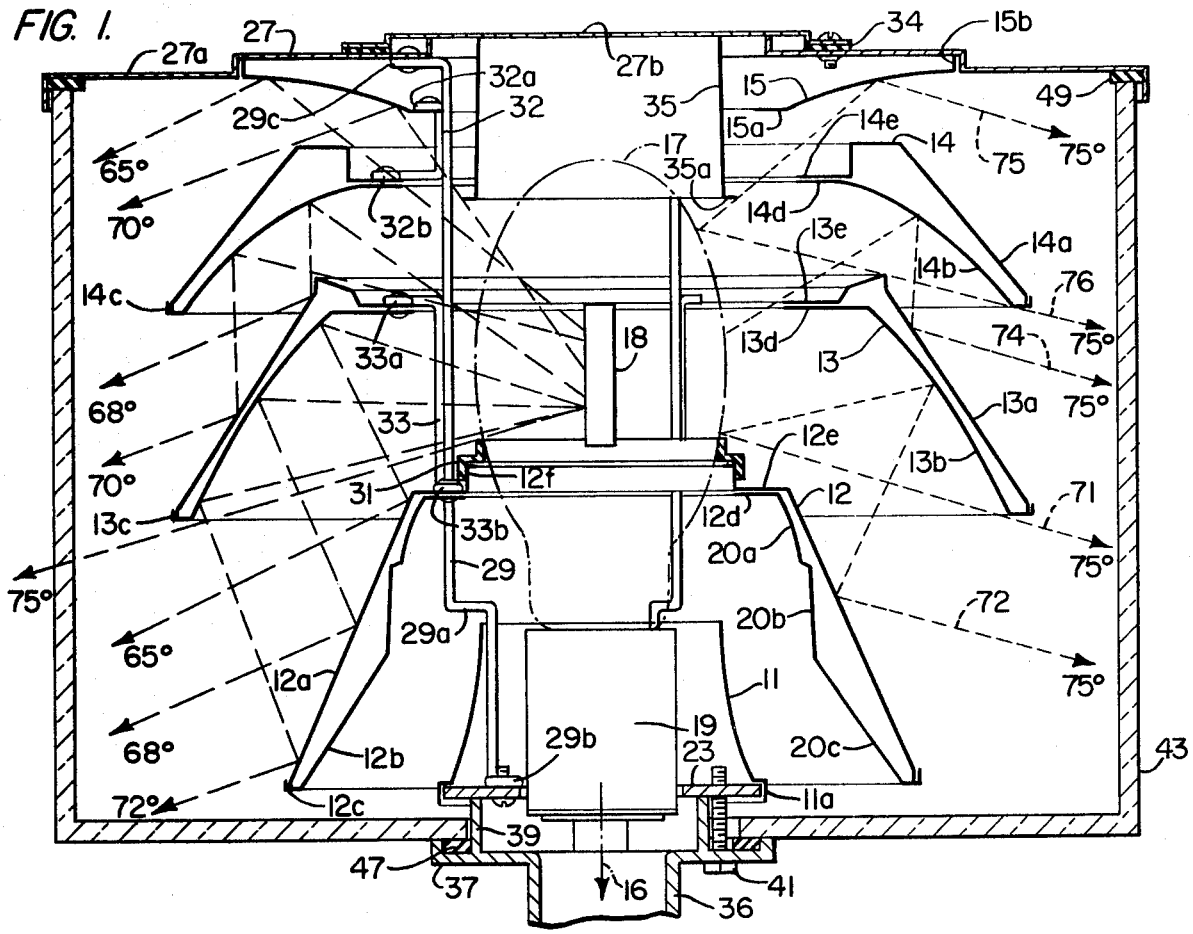
FIG. 1 is a sectional view in elevation of one embodiment of the lighting fixture of the present invention.

The lighting fixture of the present invention as shown in FIG. 1 comprises a reflector system in the form of five annular reflectors 11–15 positioned concentrically about a vertical axis 16 and surrounding a lamp 17. The lamp 17 has an elongated arc tube 18, which is the light source of the lamp, aligned with the vertical axis of the reflectors 11–15. The middle three reflectors 12–14 are generally frustoconical in shape and are positioned in a nested relationship relative to one another whereby the upper end of the reflector 12 is above the lower end of the reflector 13 and the upper end of the reflector 13 is above the lower end of the reflector 14. Reflectors 12–14 all have specular inner surfaces to reflect light received directly from the lamp 17 and the reflectors 12 and 13 have specular outer surfaces so as to re-reflect light reflected by the inner surfaces of the reflectors 13 and 14, respectively. The outer surface of the reflector 14 does not need to be specular since it does not reflect light from the source 17 but it may be made specular to provide a uniform appearance.

The lamp 17 is mounted in the socket 19 which is surrounded by the lowermost reflector 11. The reflector 11 is also generally conical in shape and has an outer specular reflecting surface so that light is doubly reflected between the reflectors 11 and 12, light rays received directly by the inner reflecting surface of the reflector 12 being reflected to the reflector 11 and then reflected outwardly and downwardly. The upper reflector 15, as shown, is also generally conical in shape but extends more laterally than the other reflectors and has a specular downwardly and outwardly facing surface to reflect downwardly and outwardly light rays received directly from the lamp 17. The inner reflecting surfaces of the reflectors 13 and 14 have a concave curvature as viewed in axial section as shown in FIG. 1 as does the reflecting surface of the reflector 15 and the reflector 11. All of the reflecting surfaces of the reflectors 11–15 are surfaces of revolution.

The inner reflecting surface of the reflector 12 is divided into three sections **20*a*, 20*b* and 20*c*, the upper section 20*a* having a concave curvature when viewed in axial section and the sections 20*b* and 20*c* being linear as viewed in axial section. The central section 20*b* of the inner reflecting surface of the reflector 12 is inclined at only a slight angle from vertical whereas the lower section 20*c* and the upper section 20*c*** are inclined at substantially greater angles with respect to vertical. The curvature of the reflectors, as well as their positions relative to one another and relative to the lamp source, have all been specifically selected so as to produce a lighting distribution over the horizontal plane below the fixture which is substantially uniform over the illuminated area as will be described in more detail below.

The reflector 12 is formed of two sheet metal pieces, one piece **12*a* providing the outer reflecting surface of the reflector and the other piece 12*b* providing the inner reflecting surface. The piece 12*b* is provided with a lip 12*c* extending around the lower end of the outer piece 12*a* to maintain the lower ends of the pieces 12*a* and 12*b* together and provide stability to the assembly of the two pieces. The upper or inner end of the sheet metal piece 12*b* is shaped into a ring 12*d*. A parallel, closely adjacent ring 12*e* is formed in the piece 12*a*. The reflector 12 is mounted in the fixture by means of these rings. In a similar manner, the reflector 13 is formed of two sheet metal pieces 13*a* and 13*b* with the piece 13*b* providing the inner reflecting surface and the piece 13*a* providing the outer reflecting surface. The inner reflector 13*b* is formed into a lip 13*c* at its lower end which fits around the lower end of the outer piece 13*a* and performs the same function as the lip 12*c*. The upper and radially inner ends of the pieces 13*a* and 13*b*, like the pieces 12*a* and 12*b*, are shaped into parallel, closely adjacent rings 13*d* and 13*e* by which the reflector 13 is mounted in the fixture. Likewise, the reflector 14 is formed of inner and outer sheet metal pieces 14*a* and 14*b* provided with a lip 14*c* at the lower end of reflector 14*b* and closely adjacent mounting rings 14*d* and 14*e* at the radially inner ends for the same purposes as in reflectors 12 and 13. The rings 13*d* and 14*d*** also serve to block rays of light which would otherwise be reflected from the fixture at angles above a selected cutoff angle of 75° as is explained in more detail below.

The reflector 11 is formed of a single sheet metal piece which is supported on a ring 23, which surrounds the socket 19 near the bottom thereof, and is provided with a lip **11*a* which fits around the outer edge of the ring 23 to maintain the axial alignment of the reflector 11. The reflector 15 is formed of a single sheet metal piece which is shaped at its inner end into a radially extending ring 15*a* by which the reflector 15 is mounted in the fixture and into a vertically extending flange 15*b* at its outer end which fits with a step in a top cover plate assembly 27** of the fixture.

The reflectors 12–15 are supported by a rod assembly in the form of three vertically extending rods 29, which are provided with right angle bends intermediate the ends thereof to define horizontal segments **29*a* extending radially from the vertical axis of the reflectors to terminate the lower ends of the rods radially inwardly from the points at which the rods support the reflectors. The ends of the rods 29 are formed into vertically facing eyelets 29*b* and 29*c*. The rods 29 are mounted on the supporting ring 23 by means of screws passing through the eyelets 29*b*. The top cover assembly 27 for the fixture is fixed to the upper end of the rods 29 by rivets passing through the eyelets 29*c*. Fixed to the rods 29 are smaller rods 32 and 33, each having a vertically extending leg welded to the rod 29 and a horizontal leg extending radially outwardly from the vertical axis of the reflector system. The ends of the rods 32 and 33 are formed into vertically facing eyelets 32*a*, 32*b* and 33*a* and 33*b*, respectively. The reflector 14 is mounted on the rods 32 by rivets passing through the eyelets 32*b* and through the rings 14*d* and 14*e*. The reflector 13 is mounted on the rods 33 by rivets passing through the eyelets 33*a* and through the rings 13*d* and 13*e*. The reflector 15 is mounted on the rods 32 by rivets passing through the eyelets 32*a* and the ring 15*a*. The reflector 12 is mounted on the rods 33 by rivets passing through the eyelets 33*b* and the rings 12*d* and 12*e***. An alternative method of attaching the rods to the reflectors would be to have the rods pass through the reflectors and the reflectors would be fastened to the rods by self threading nuts.

The piece **12*a* is formed into a cylindrical section 12*f* at its inner side extending upwardly from the inner edge of the ring 12*e*. The cylindrical section 12*f* has a circular inwardly extending flange at its upper end. A circular rubber gasket 31 is shaped to fit over the section 12*e* and extend inwardly over the top thereof to surround the lamp 17 and may serve to support the lamp 17 centered on the vertical axis of the reflector system. The socket 19 for the lamp 17 may be spring-mounted to permit centering action by the gasket. The gasket 31** also serves to prevent light from being radiated at greater angles than the 75° cutoff angle as will be explained in more detail below.

The top cover plate assembly 27 is formed of an outer annular section 27a and a central plate 27b screwed to the section 27a through a gasket 34. Fixed to the plate 27b is a cylindrical cup-shaped baffle 35, the open end of which extends down around the top of lamp 17. The bottom edge of the baffle 35 is formed with an outwardly extending flange 35a which serves the function of preventing light from being radiated above the 75° cutoff angle as will be explained in more detail below. The assembly of the plate 27b and the baffle 35 is removable for relamping.

The fixture in FIG. 1 is shown supported on a vertical post 36 which is provided with a flange 37 at its upper end. Integral with the flange 37 is an upwardly extending cylindrical member 39 which is spaced inwardly from the outer edge of the flange 37. The ring 23, and thereby the rods 29, the reflectors and the top cover plate assembly, are supported on the cylindrical member 39. The ring 23 is securely held on the cylindrical member 39 by means of screws 41 passing through the flange 37 and the ring 23 outside the member 39. A light transmitting enclosure 43, made of transparent material, extends from the outer edge of the annular section 27a to between the ring 23 and the flange 37 and rests on the flange 37. The outer end of the flange 37 is formed into an upwardly extending lip in which a gasket 47 fits. The gasket 47 severs to prevent entry of moisture and insects into the enclosure. The upper end of the enclosure 43 fits inside of the downwardly extending lip on the outer edge of the section 27a and a gasket 49 separates the upwardly facing top edge of the enclosure 43 from the section 27a.

Figure 3:
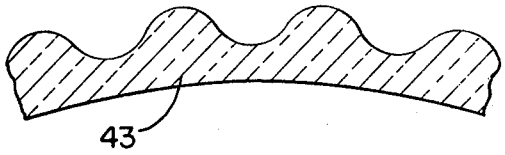
FIG. 3 is a sectional view of the light transmitting outer enclosure of the fixture to illustrate the ribbed shape of the enclosure.

The enclosure 43 preferably may have an annular or square outer wall and a flat, horizontal bottom wall. The outer wall has vertically extending ribs defined therein, as illustrated in FIG. 3, by having its outer surface shaped as a sinewave to vary the wall thickness between about one-fourth and one-eighth of an inch. The distance between the peaks of the sinewave is about one-half of an inch. The outer surface is mathematically cylindrical in that it is defined by the locus of a straight line moved through a path maintained parallel to the vertical axis of the reflector system. This shape for a vertical enclosure wall has the effect of diffusing the light rays which pass through the outer cylindrical wall through horizontal angles but making no change in the angular direction in which the light is projected vertically. Similar ribs may also be employed in an enclosure wall angled from vertical to achieve the same effect. This is important in order not to interfere with the sharp cutoff above 75° and the uniform distribution of light over the illuminated area achieved by the reflector system. The ribbing on the enclosure 43 has another advantage when the fixture is positioned in a setting in which the unit would be viewed at angles below 75° from downward vertical. As explained in more detail below, the fixture cuts off all light projection above 75° from downward vertical and in this manner effectively eliminates glare from the fixture when the fixture is in a normal setting as the viewing angle in a normal setting is above 75° from downward vertical. The fixture of the present invention does project great intensities of light at angles below 75° from downward vertical and when these intensities are in the normal viewing angles because of an unusual setting, the projected light would be perceived by the viewer as glare. The ribbing, while it does not reduce the total amount of light projected at these angles and thereby prevent reduction in visibility caused by any such glare, it does spread the light over the surface of the enclosure thereby reducing the point brightness and the discomfort caused by the glare.

Figure 5:
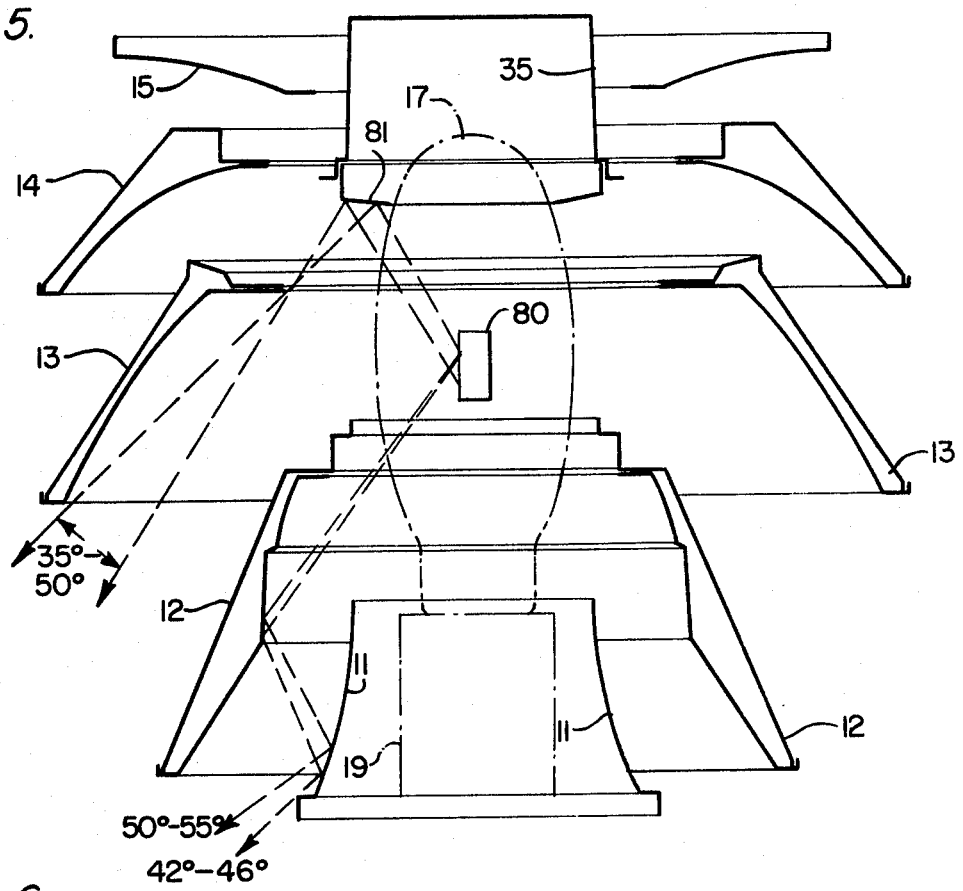
FIG. 5 is a sectional view in elevation of a modified reflector arrangement to provide uniform distribution when a lamp with a very short arc tube and a transparent envelope is used in the fixture.

The basic reflector system, as described in FIG. 1, may be used with different lamps such as lamps with different length arc tubes or lamps with transparent or phosphor coated envelopes. However, when a lamp with a clear envelope and a very short arc tube, such as a metal halide lamp, is used, a modification in the reflector system is needed to achieve the most uniform distribution over the illuminated area as is explained in more detail below with reference to FIG. 5. The fixture in FIG. 1 is shown with a lamp having a relatively long arc tube 18.

Figure 4:
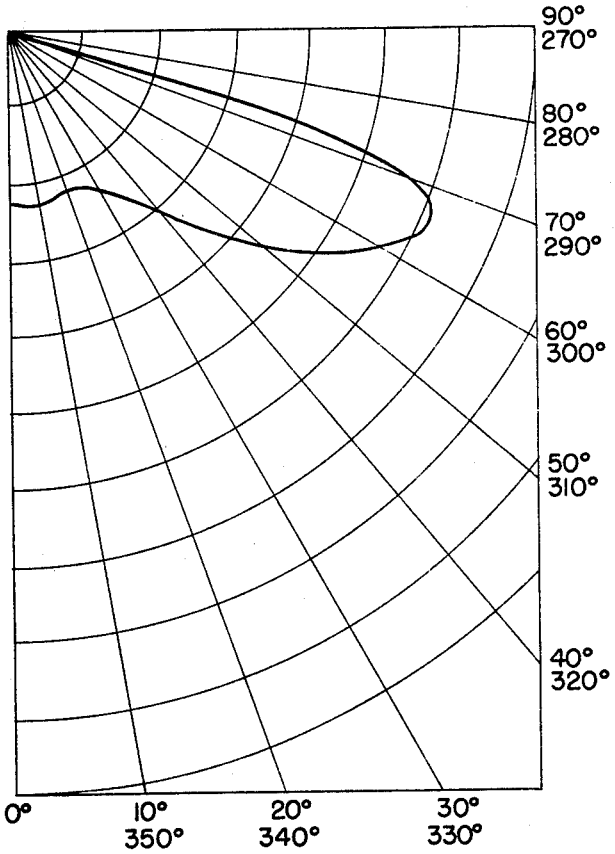
FIG. 4 illustrates the candle power distribution curve achieved by the reflector system of FIGS. 1 and 2.

The reflector system of the present invention achieves a uniform distribution of light over the illuminated area with a cutoff of projected light above 75°. To obtain this distribution, the reflecting surfaces of the reflecting system are shaped and positioned so as to produce a batwing-shaped candle power distribution curve as shown in FIG. 4. Such a distribution curve means that the greatest intensity light is projected at angles near, but below, the cutoff angle and the intensity progressively decreases with decreasing angles of projected light with respect to downward vertical. The reflector system of the present invention concentrates light in the range of 65° to 72° from the downward vertical to achieve high intensity in the range by combining double reflections between the reflectors 12 and 13, double reflections between the reflectors 13 and 14, single reflections from the reflector 15, and light directly radiated from the source 18 between the reflectors 12 and 13 without reflection. In FIG. 1, rays of light are represented by dashed line arrows and the angles at which the various rays are directed with respect to downward vertical are indicated at the end of each corresponding dashed line arrow. As illustrated, light rays radiating from the center of the source 18 above 75° up to angles above horizontal are doubly reflected between the reflectors 12 and 13 so as to be projected in the range of 65° to 72° with respect to downward vertical. Light rays radiated from the center of the source at higher angles are doubly reflected between reflections 13 and 14 to be projected in the same range. Light rays radiated from the center of the source 18 at still higher angles are singly reflected from the reflector 15 to be projected also in this same range. In this manner, by a combination of effects, a high intensity beam is achieved in the 65° to 72° range as desired.

The worst case for achieving cutoff above a selected cutoff angle is with a light source having a long arc tube like that shown in FIG. 1 or having a phosphor coated envelope, as such lamps radiate light from a larger distributed area. How the system achieves cutoff above 75° is best illustrated by the light rays represented on the right side of FIG. 1. As shown, direct, unreflected light from the lamp 17 can only pass between the reflector 13 and the gasket 31 at up to 75°. The relative positions of the gasket and the bottom of the reflector 13 prevent direct light rays at higher angles. The light ray 71 represents the upper angular limit at which light rays can be directly radiated without reflection. Direct light rays at higher than this angle will be intercepted either by the reflector 13 or the gasket 31. Light rays from the lower end of the long source 18, which otherwise would be doubly reflected between the reflectors 12 and 13 at higher than 75°, are also cut off by the gasket 31 as would be light rays from low points on a phosphor coated envelope. The lower on the lamp that a given light ray is generated, the higher it will be directed after double reflection between the reflectors 12 and 13. The light ray 72 represents the angular upper limit at which light rays can be projected after being doubly reflected between the reflectors 12 and 13. Light rays from the lower end of the source 18, which would otherwise be projected at angles higher than the 75° cutoff after double reflections between the reflectors 13 and 14, are intercepted by the ring 13*d*. Light ray 74 represents the upper angular limit at which light can be projected after double reflection between the reflectors 13 and 14. Light rays from the upper end of the lamp or source, which otherwise would be reflected by the reflector 15 at angles greater than 75°, are cut off by the flange 35*a*. The upper angular limit at which light can be reflected from the reflector 15 is represented by the light ray 75. A phosphor coated lamp will radiate direct rays without reflection between the reflectors 13 and 14. The relative position of the highest point on the reflector 13 and the bottom of the reflector 14 limits this radiation to 75° or less. The ray 76 represents the upper angular limit at which such rays can be radiated.

Figure 2:
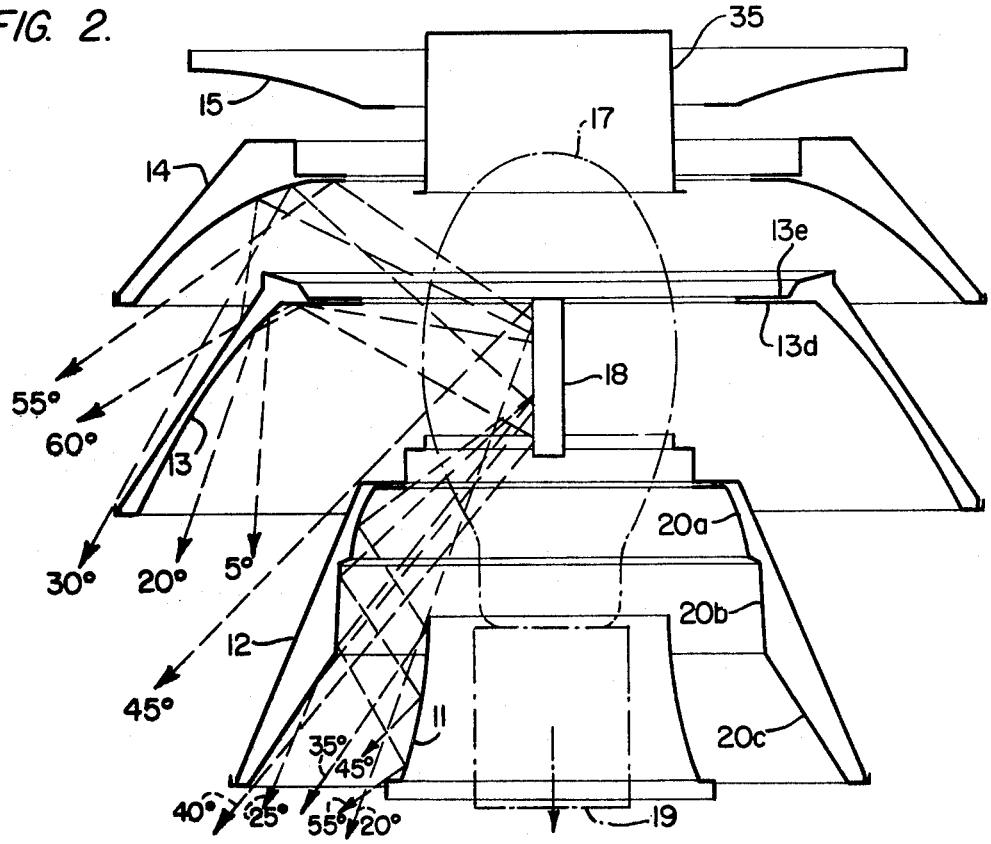
FIG. 2 is a sectional view in elevation of the reflector system of FIG. 1 to show how the reflector system provides light at low angles from vertical to achieve uniform distribution of light.

FIG. 2 illustrates how the system projects rays from 65° to downward vertical. As shown in this figure, light from over the entire length of the source 18 impinging upon near the inner end of the lower reflecting surface of the reflector 14 are singly reflected and radiated in a range of angles from 30° to 55°. Light from the upper end of the source 18 is doubly reflected between the reflectors 13 and 14 at about 60°. Direct light from the upper end of the source 18 is radiated downwardly without reflection between reflectors 12 and 13 down to angles of 45°. Light from near the lower end of the source, which is intercepted by the lower ring 13*d*, is doubly reflected by the reflector 13 and projected in the range of 5° to 20° to provide fill light in this area. Direct light from 20° to 40° is radiated without reflection between the reflectors 11 and 12. In addition, light is doubly reflected between these reflectors to provide light in the range of 35° to 55° as shown. Also, light is singly reflected from the lower section 20*c* to provide light projected at about 25°.

Progressively decreasing intensity from 65° to downward vertical is achieved through a combination of effects. The reflector contours and positions are selected to cause light rays radiated at different angles from different points on the source 18 to add up in a manner to provide progressively decreasing intensities of light projected from the fixture as the angle from vertical decreases from 65° to vertical downward. It will be observed that direct unreflected light from the source is used to provide much of the light projected below 65°. The light intensity naturally decreases as vertical is approached because the effective length of radiating source decreases. However, in the range of 35° to 50°, the gasket 31 blocks out some of this light. Accordingly, to avoid a dip in the illumination in this area, additional light must be projected by the reflector system in this range. This is accomplished by light doubly reflected between the reflectors 11 and 12 and as light singly reflected from near the inner edge of the downwardly facing reflector 14.

It will be observed that the uniform light distribution with cutoff above 75° is achieved making use of almost all of the radiated light; that is very little of the radiated light is blocked without being redirected to another area where the light is needed. This means that the uniform distribution of light is achieved with a very high degree of efficiency.

Relamping of the system as shown in FIG. 1 may readily be carried out simply by unscrewing the plate 27*b* from the section 27*a* and lifting the plate 27*b* along with the baffle 35*a* to provide access to the lamp. If it is desired to replace the enclosure 43, this is achieved simply with the system as illustrated in FIG. 1 by removing the screws 41 and lifting out the entire assembly of the reflector system as well as the top plate assembly leaving only the enclosure 43 on the flange 37, thus permitting easy replacement.

When a lamp with a clear envelope and a very short arc tube is used, such as a metal halide lamp, the reflecting system specifically, as shown in FIG. 1, will not provide sufficient light intensity at angles from 35° to 55° to achieve the desired uniform distribution in the illuminated area. However, the same basic reflector system can be readily modified to achieve sufficient intensities at these angles with a such a lamp in the manner illustrated in FIG. 5. As shown in this figure, the lamp 17 has a very short arc tube 80 as a light source. Because of the shortness of the source 80, the lamp only radiates light up to 35° between the reflectors 11 and 12 without reflection and down to an angle of only 55° between the reflectors 12 and 13 without reflection. The resultant gap in the angles of radiation between 35° and 55° would create a nonuniform distribution if the very short arc tube lamp were used with the reflector system of FIGS. 1 and 2 without modification. To prevent this nonuniformity from occurring, when the very short arc tube lamp is used, an additional reflector 81 is provided generally in the shape of a ring just below the baffle 35 concentric about the axis of the reflecting system. The bottom of the baffle is provided with a step to mount the reflector 81 as shown. The reflector 81 is thus removable along with the baffle 35 and the central plate 27*b* for relamping. The reflector 81 faces downwardly and slightly outwardly and extends inwardly from the bottom of the baffle 35. In this manner, the reflector 81 is positioned above the reflector 13 and even with the reflector 14 and intercepts light radiated from the source 80 at a high vertical angle and reflects this light between the reflectors 12 and 13 in the 35° to 50° range. In addition, the reflector 11 is lengthened to extend below the reflector 12 and is provided with a linear shape in axial section at its lower end so as to re-reflect light reflected by the section 20*b* of the reflector 12 in the ranges of 50° to 55° and 42° to 46°. In this manner, the needed additional light in the 35° to 55° range is provided in order to achieve uniform distribution when a short arc length lamp is used. It will be noted that the modification can be provided to the basic system at very little cost just by adding a simple additional reflector 81 which may readily be mounted on the baffle 35 and by modification of the reflector 11. This latter modification may be employed in the basic reflector system for use with lamps having long arc tubes or phosphor coated envelopes so that the only modification required in the basic reflector system to adapt it for short arc tubes or phosphor coated envelopes is the addition of the reflector 81.

Figure 6:
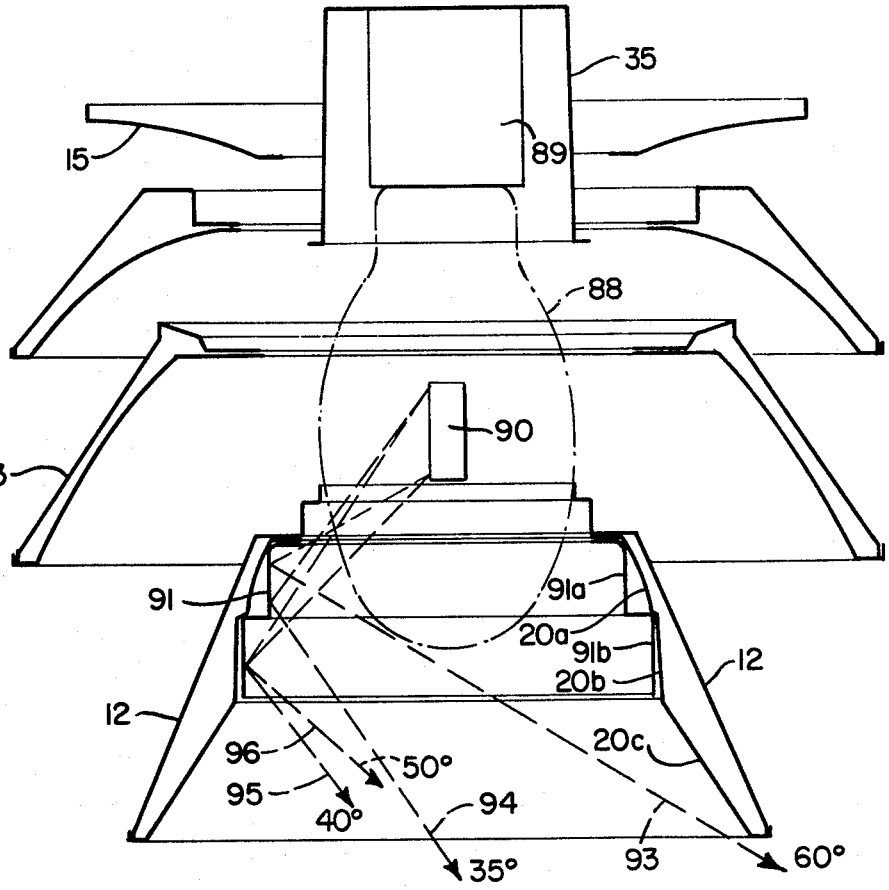
FIG. 6 is a sectional view in elevation of a reflector system for a unit in which the lamp extends downwardly from the socket instead of upwardly as in the systems shown in FIGS. 1 and 5.

FIG. 6 illustrates how the basic reflector system may be used in a fixture in which the lamp is mounted extending downwardly from the socket instead of upwardly as in FIGS. 1–3. In this figure, the lamp is designated by the reference number 88 and the socket is designated by the reference number 89. The socket is mounted inside the baffle 35 and the lamp extends down from the socket on the axis of the reflectors to locate the arc tube 90 in the same position relative to the reflectors as in the system of FIG. 1. In this embodiment, the bottom reflector 11 is eliminated to permit easy relamping. Light in the 35° to 55° range, which is produced by the bottom reflector in the system of FIG. 1, is produced by an added stepped reflector 91 positioned within the reflector 12. The reflector 91 has an upper, cylindrical reflecting surface 91*a* and a lower cylindrical surface 91*b* with the surface 91*b* being of greater diameter than the surface 91*a*. The surface 91*a*, corresponding in vertical location with the reflecting surface 20*a* of the reflector 12*b*, has a smaller diameter than this surface. The reflector 91*b* has the same vertical location as the reflecting surface 20*b* of the reflector 12 and, like wise, has a slightly smaller diameter than the surface 20*b*. The surfaces 91*a* and 91*b* reflect light in the range of 35° to 60° as represented by the rays 93 through 96.

Figure 7:
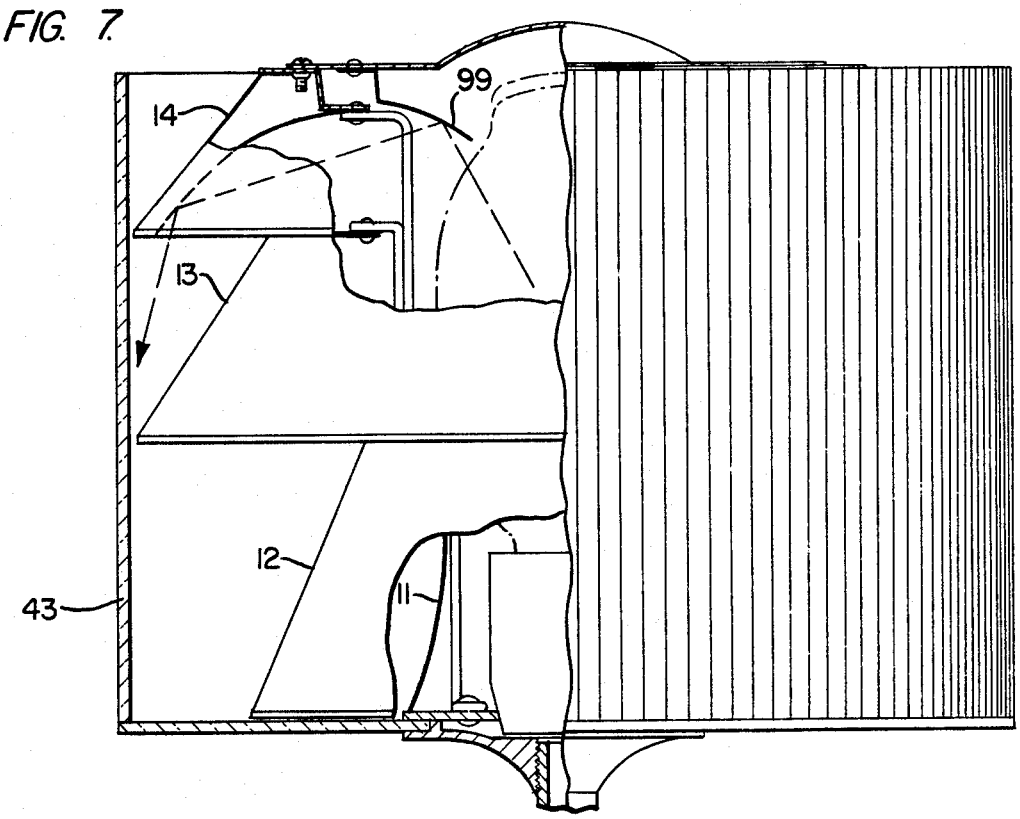
FIG. 7 is a view in elevation and in partial section showing an alternative embodiment of the invention with a modified reflector system to achieve a modified external appearance of the unit.

It may be desirable in some instances for esthetic reasons to eliminate the top reflector 15. Such a modification of the system is illustrated in FIG. 7. As shown in this figure, the top reflector 15 has been replaced by a reflector 99 attached to the top plate assembly. The reflector 99 has a downwardly and outwardly facing surface, which is concave in axial section and is positioned radially inwardly from the reflector 14 so as to reflect high angle light for re-reflection from the reflector 14 providing additional low angle light. Because the light from the top reflector 15 has been eliminated from the main beam projected in the 65°–71° range, the reflector shown in FIG. 7 does not produce light over the illuminated area as uniformly as the systems shown in FIGS. 1, 5 and 6.

Figure 8:
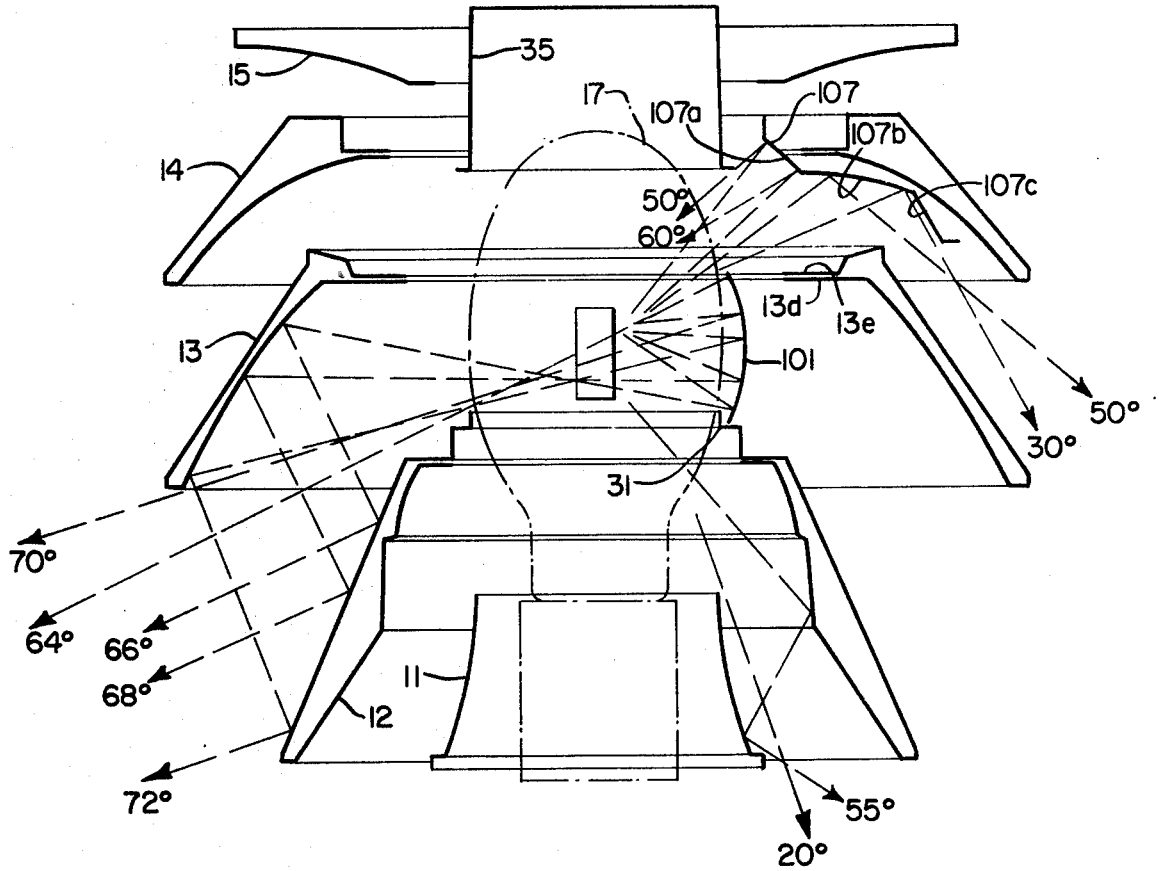
Figure 9:
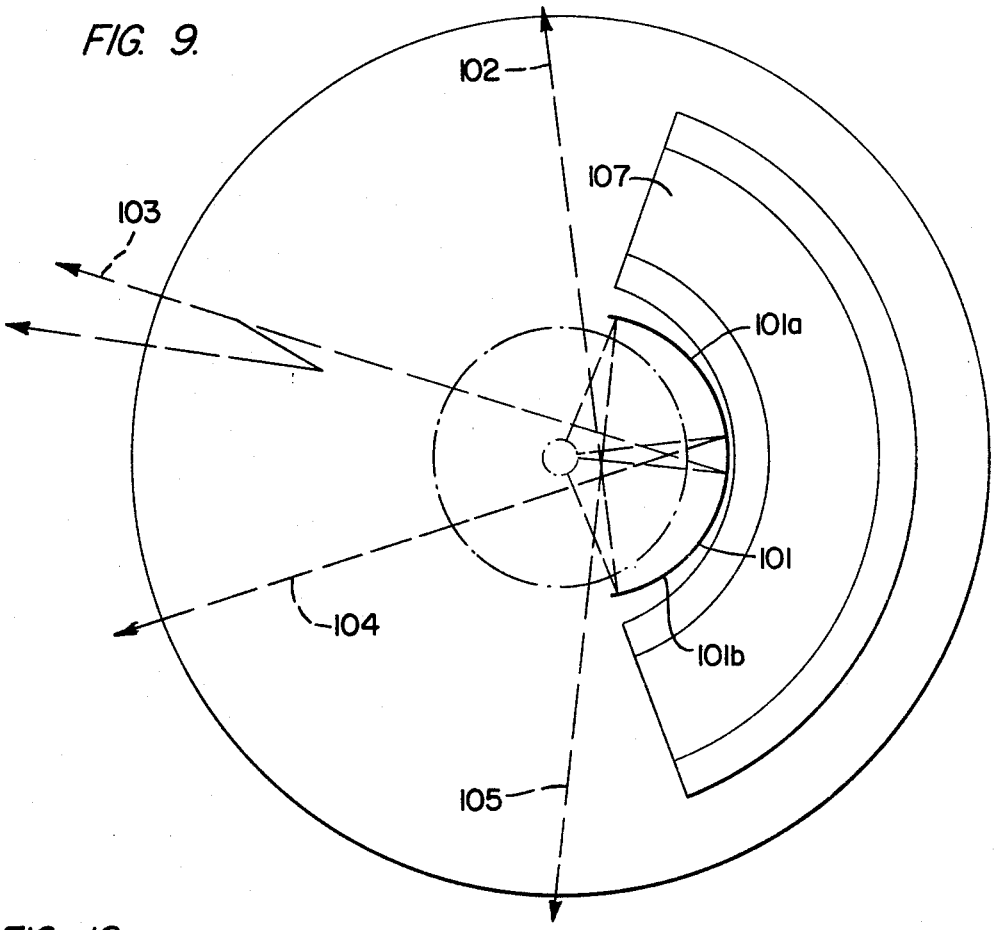
FIG. 9 is a top plan view of the reflector system shown in FIG. 8 with a portion thereof to more clearly illustrate the reflector modification in FIG. 8.

The systems illustrated in FIGS. 1–7 all produce a symmetric circular distribution of light around the fixture. In some applications, it is desirable to produce an asymmetrical distribution such as in roadway or street lighting from a point near the curb of the street. FIGS. 8 and 9 show how the basic reflecting system of the present invention can be modified for a street application for use with a lamp having a clear envelope. This fixture concentrates additional light at high angles below the cutoff angle of 75° on the street side of the fixture and eliminates the high angle of light on the off-street or house side of the fixture while still producing low angle light on the house or off-street side of the fixture for sidewalk lighting. The fixture produces a broad, uniform distribution on the street side for efficient street lighting and also low angle uniform distribution on the off-street or house side to efficiently illuminate the sidewalk.

As shown in FIGS. 8 and 9, an additional reflector 101, concave in axial section, has been added positioned radially inward of the reflectors 12–15 close to the glass envelope of the lamp 17 and extending axially from just above the gasket 31 up to the rings 13*d* and 13*e* so as to intercept light that would otherwise be radiated between the reflectors 12 and 13. As best shown in FIG. 9, which is a plan view of the reflector system of FIG. 8 with the reflectors 14, 15 and the baffle 35 removed, the reflector 101 extends around the vertical axis through an angle of about 140°. The reflector 101 is formed of two congruent arcuate sections 101*a* and 101*b* joining at a point opposite the side of the fixture designed to face the street. The arcuate sections are symmetrical about a plane passing through the junction of the sections and the vertical axis and each section does not face straight toward the vertical axis. The sections face in directions on opposite sides of the vertical axis so as to cause all reflected light to pass outside of the arc tube of the lamp as illustrated by rays 102 through 105 in FIG. 9. A second reflector 107 is also added to the fixture extending around the vertical axis of the system through the same 140° angle through which the reflector 101 extends. As shown in FIG. 8, the reflector 107 is formed of three sections 107*a*, 107*b* and 107*c* which are each surfaces of revolution concentric about the vertical axis. The reflector 107 is positioned between the reflectors 13 and 14 close to the inner reflecting side of the reflector 14, as shown. The inner section 107*a* defines a reflecting surface facing inwardly and downwardly to reflect rays radiated at high angles on the house side toward the reflector 15 back through the lamp envelope in the range of 50° to 60° from vertical on the street side of the fixture. The middle section 107*b* defines a reflecting surface, which is concave in axial section and faces downwardly and slightly inwardly. The section 107*b* reflects light downwardly in a range of 30° to 50°.

As shown in FIG. 8, some of the light reflected by the reflector 101 passes between the reflectors 12 and 13 on the opposite side of the fixture without reflection and is projected in the main beam in the range of 64° to 74°. Other light reflected at higher angles by the reflector 101 is doubly reflected between the reflectors 13 and 14 in the range of 64° to 72°. Thus, it will be seen that the reflector 101 serves to eliminate the light that would normally be doubly reflected between the reflectors 12 and 13 and be projected in the main beam of light on the house side of the fixture and adds this light to the main beam on the street side of the fixture. The reflector 107 also intercepts light which otherwise would be projected in the main beam on the house side by double reflection between reflectors 13 and 14 and single reflection from the reflector 15. The reflecting surface 107*a* provides additional light in the 50°–60° range on the street side and serves to help maintain the uniform distribution of light on the street side for lamps with relatively short arc tubes. The section 107*b* reflects light downwardly in the 30°–50° range to provide additional house-side lighting at low angular levels. The section 107*c* serves as a light intercepting baffle. Low angle light is reflected between the reflectors 11 and 12 on both the house and street side in the same manner as in the fixture of FIG. 1.

Figure 10:
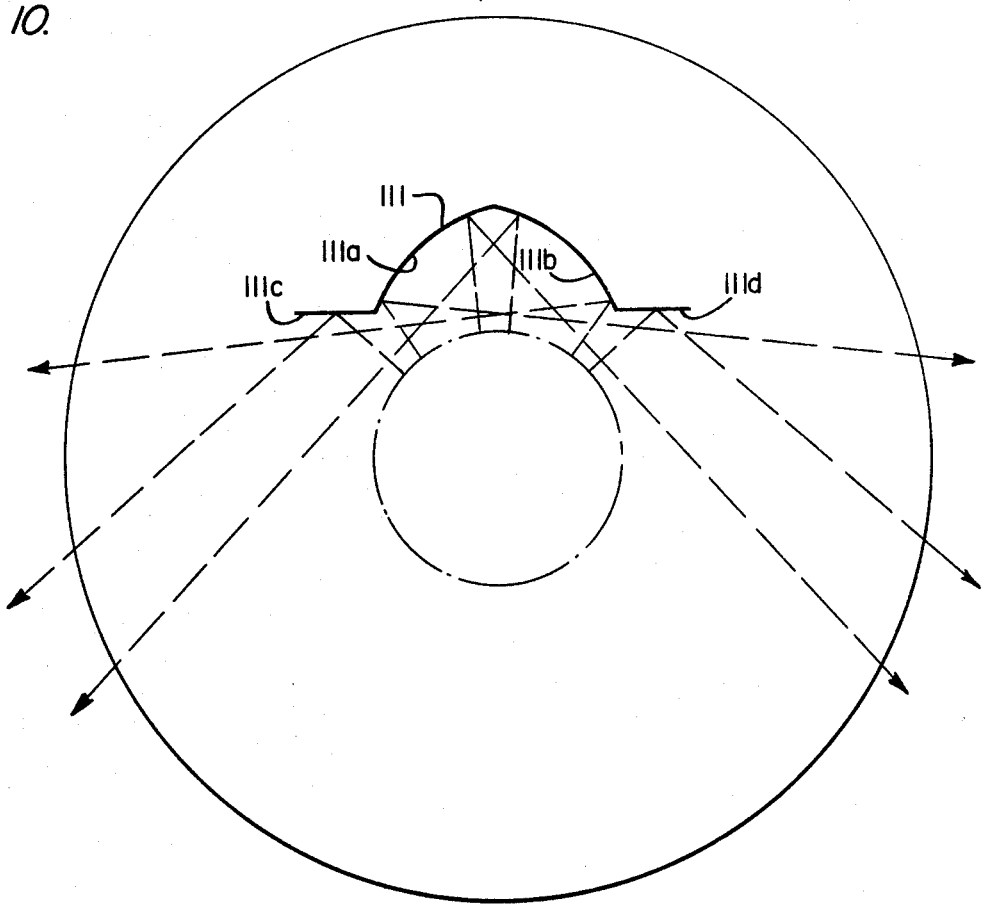
FIG. 10 is a top plan view illustrating an alternative modification of the reflector system to achieve asymmetrical illumination for use with a lamp having a diffusive coated envelope.

The reflector 101 contour will throw approximately the same amount of light at all radial angles on the street side of the unit. By altering the contour of the reflector 101, more light can be concentrated at select angles such as 10°–30° from the curbside to provide different selected patterns of light distribution. The use of the reflector 101 requires the lamp to have a clear envelope because the light is reflected through it. If the lamp has a diffusive coated envelope, the shape of the reflector 101 as viewed along the vertical axis must be altered so as to reflect light outside the glass envelope. FIG. 10 illustrates in plan view an asymmetric reflector 111 for use with phosphor coated lamps reflecting light back outside the envelope of the lamp. This reflector replaces and is positioned in the same vertical position in the fixture as the reflector 101 in FIG. 8. As shown in FIG. 10, the reflector 111 is formed of two arcuate sections 111*a* and 111*b*, positioned to reflect light from the lamp outside the glass envelope, and reflecting surfaces 111*c* and 111*d* which are directly facing the street side at the outer ends of the reflector 111. As illustrated in FIG. 10, a reflector with this contour will direct all reflected rays outside of the envelope of the lamp source.

The reflector system used in the above described fixtures thus achieves uniform distribution of light with a cutoff of projected light above 75° from downward vertical with high efficiency. Moreover, the basic reflector system can be simply modified to make it effective to achieve uniform distribution with lamps having clear envelopes and very short arc tubes or to provide uniform asymmetric light distribution. The above described specific embodiments may be modified without departing from the spirt and scope of the invention as defined in the appended claims.

I claim:

1. A light fixture comprising a light source, a reflector system surrounding said light source shaped and arranged to concentrate light in a first angular range measured from downward vertical and provide progressively decreasing intensity of projected light with changes in the angle of projection from said range to downward vertical, said reflector system including an upper, middle and lower nested reflectors generally frustoconical in shape having a common vertical axis passing through said source, the upper one of said reflectors having an inner reflecting surface facing inwardly and downwardly, the lower one of said reflectors having an outer reflecting surface facing outwardly and upwardly and the middle one of said reflectors having an inner reflecting surface facing inwardly and downwardly and an outer reflecting surface facing upwardly and outwardly, said reflectors being shaped and arranged so that light radiated by said source is reflected by the reflecting surface of said upper reflector to the outer reflecting surface of said middle reflector and then re-reflected in said first angular range, light radiated by said source is reflected from the inner reflecting surface of said middle reflector and then re-reflected by the reflecting surface of said lower reflector in said first angular range, and light radiated by said source will pass without reflection between said middle and lower reflectors and be projected in a second angular range measured from downward vertical extending below said first range.

2. A lighting fixture as recited in claim 1, wherein the reflecting surface of said upper reflector and the inner reflecting surface of said middle reflector are concave in axial section.

3. A light fixture as recited in claim 1, wherein said reflector system further includes a fourth reflector having a generally frustoconical reflecting surface concentric about said vertical axis facing outwardly and downwardly and positioned above said upper reflector, said reflecting surface of said fourth reflector being shaped and arranged so that light radiated by said source is projected in said first angular range after a single reflection from the reflecting surface of said fourth reflector.

4. A lighting fixture as recited in claim 3, wherein the reflecting surfaces of said upper reflector and said fourth reflector and the inner reflecting surfaces of said middle reflector are concave in axial section.

5. A light fixture as recited in claim 3, wherein said lower reflector has an inner reflecting surface and wherein said reflector system includes a fifth reflector defining a reflecting surface in the form of a surface of revolution positioned within said lower reflector concentric about said vertical axis and facing outwardly, said inner reflecting surface of said lower reflector and the reflecting surface of said fifth reflector being shaped and arranged so that light radiated by said source is reflected by the inner reflecting surface of said lower reflector to the reflecting surface of said fifth reflector and then re-reflected in a third angular range measured from downward vertical below said first angular range.

6. A light fixture as recited in claim 5, wherein said second angular range extends from at least the top of said first angular range to at least the top of said third angular range.

7. A light fixture as recited in claim 1, wherein said lower reflector has an inner reflecting surface and wherein said reflecting system includes a fourth reflector having a reflecting surface formed as a surface of revolution concentric about said vertical axis facing outwardly within said lower reflector, the inner reflecting surface of said lower reflector and the reflecting surface of said fourth reflector being shaped and arranged so that light from said source is reflected from said inner reflecting surface of said lower reflector to the reflecting surface of said fourth reflector and then re-reflected in a third angular range measured from downward vertical below said first angular range.

8. A lighting fixture as recited in claim 7, wherein light radiated from said source passes between said lower reflector and said fourth reflector without reflection to be projected from the fixture in a fourth angular range measured from downward vertical, said third angular range extending above said fourth angular range.

9. A lighting fixture as recited in claim 1, wherein said reflector system is shaped and arranged to generate light intensity distribution in a vertical plane containing said vertical axis varying substantially in accordance with the distribution curve illustrated in FIG. 4.

10. A lighting fixture as recited in claim 1, wherein said reflecting system includes means to cut off all light projected by said fixture above a predetermined cutoff angle from downward vertical greater than said first angular range and less than 90°.

11. A lighting fixture as recited in claim 10, wherein said cutoff angle is about 75°.

12. A lighting fixture as recited in claim 11, wherein said first range extends from about 65° to 71° from downward vertical.

13. A lighting fixture as recited in claim 10, wherein said light source comprises a lamp having an envelope and wherein said means to cut off projected light above a predetermined angle includes a gasket engaging said envelope, said gasket blocking light from said lamp that otherwise would be projected from the fixture at greater than said cutoff angle.

14. A lighting fixture as recited in claim 10, wherein said means to cut off light projected from said fixture above a predetermined cutoff angle includes means positioned adjacent to the upper end of said lower reflector to block light that otherwise would be radiated by said source to between said middle and lower reflectors and be projected from the fixture at angles from downward vertical greater than said cutoff angle.

15. A lighting system as recited in claim 10, wherein said means to cut off light projected above a predetermined cutoff angle includes means positioned adjacent to the upper end of said middle reflector and inwardly therefrom and positioned to block light that otherwise would be radiated from said source to between said middle and upper reflectors and be projected at angles from downward vertical greater than said cutoff angle.

16. A lighting fixture as recited in claim 15, wherein said means comprises a ring extending inwardly from the top above said middle reflector.

17. A lighting fixture as recited in claim 16, wherein said ring defines a downwardly facing reflecting surface to reflect light to the inner reflecting surface of said middle reflector to be re-reflected in a third angular range from downward vertical lower than said first angular range.

18. A lighting system as recited in claim 1, wherein said reflector system includes means to project rays from said fixture asymmetrically with respect to downward vertical to provide illumination in said first range only on one side of said fixture.

19. A lighting fixture as recited in claim 18, wherein said means to project rays asymmetrically comprises a reflector positioned between said middle and lower reflectors extending only on the opposite side of said light source from said one side so as to reflect light that would normally be reflected between said middle and lower reflectors on said opposite side of said light source to said one side of said light source.

20. A lighting fixture comprising a light source, a reflecting system positioned around said light source shaped and arranged to concentrate light in a first angular range measured from downward vertical and provide progressively decreasing intensity of projected light with changes in the angle of projection from said range to downward vertical, said reflecting system including means defining a first reflecting surface generally frustoconical in shape facing inwardly and downwardly and positioned concentrically about a vertical axis passing through said light source, means defining a second reflecting surface generally frustoconical in shape facing outwardly and upwardly and positioned concentrically about said vertical axis below said first reflecting surface and nested with said first reflecting surface whereby the upper end of said second reflecting surface is above the lower end of said first reflecting surface, said first and second reflecting surfaces being positioned and arranged so that light radiated from said source is reflected by said first reflecting surface to said second reflecting surface and then re-reflected in said first angular range from downward vertical and light radiated from said source will pass between said first and second reflecting surfaces without reflection in a second angular range from downward vertical extending below said first range, and upper reflecting means to reflect light radiated at angles from downward vertical to pass above said first reflecting surface and project the reflected light in said first angular range.

21. A lighting fixture as recited in claim 20, wherein said first reflecting surface is concave in axial section.

22. A lighting fixture as recited in claim 20, wherein said reflecting system further comprises means defining a third reflecting surface in the form of a surface of revolution facing inwardly adjacent to and inward of said second reflecting surface and means defining a fourth reflecting surface in the form of a surface of revolution within said third reflecting surface and facing outwardly, said third and fourth reflecting surfaces being concentric about said vertical axis, said third and fourth reflecting surfaces being shaped and arranged so that light radiated by said source will be reflected by said third reflecting surface to said fourth reflecting surface and then be re-reflected in a third angular range from downward vertical below said first angular range.

23. A lighting fixture as recited in claim 20, wherein said upper reflecting means comprises means defining a third generally frustoconical reflecting surface facing upwardly and outwardly positioned adjacent to and outward from said first reflecting surface and means defining a generally frustoconical fourth reflecting surface facing inwardly and downwardly and positioned above said third reflecting surface, said third and fourth reflecting surfaces being concentric about said vertical axis, said third and fourth reflecting surfaces being shaped and arranged so that light radiated from said source will be reflected by said fourth reflecting surface to said third reflecting surface and then re-reflected in said first angular range.

24. A lighting fixture as recited in claim 23, further comprising means positioned adjacent to the upper end of said first reflecting surface and extending inwardly therefrom to block light which otherwise would be radiated from said source to between said third and fourth reflecting surfaces and be projected from said fixture at greater than a predetermined cutoff angle from downward vertical, said cutoff angle being above said first angular range and being less than 90°.

25. A lighting fixture as recited in claim 23, wherein said upper reflecting means comprises means defining a fifth reflecting surface generally frustoconical in shape and facing outwardly and downwardly and positioned above said fourth reflecting surface, said fifth reflecting surface comprising means to reflect light radiated from said source at angles to pass above said fourth reflecting surface and project the reflected light in said first angular range.

26. A lighting fixture as recited in claim 25, wherein said first, fourth and fifth reflecting surfaces are concave in axial section.

27. A lighting fixture as recited in claim 25, wherein said reflecting system further includes means defining a sixth reflecting surface in the form of a surface of revolution facing inwardly and positioned adjacent to said second reflecting surface and inwardly thereof and means defining a seventh reflecting surface in the form of a surface of revolution facing outwardly and positioned within said sixth reflecting surface, said sixth and seventh reflecting surfaces being shaped and arranged so that light radiated from said source is reflected by said sixth reflecting surface to said seventh reflected surface and re-reflected thereby in a third angular range from downward vertical below said first angular range.

28. A lighting fixture as recited in claim 20, wherein said reflector system includes means positioned adjacent to the upper end of said second reflecting surface to block light that otherwise would be radiated by said source to between said first reflecting surface and second reflecting surface and be projected from the fixture at angles from downward vertical greater than a predetermined cutoff angle from downward vertical, said cutoff angle being above said first angular range and less than 90°.

29. A lighting system as recited in claim 20, wherein said reflecting system is shaped and arranged to project rays from said fixture asymmetrically with respect to said vertical axis to provide illumination in said first angular range only on one side of said fixture.

30. A lighting fixture as recited in claim 29, wherein said reflecting system further comprises a reflector positioned between said first and second reflecting surfaces extending only on the opposite side from said one side of said light source so as to reflect light that would normally be radiated by said source to between said first and second reflecting surfaces on said opposite side of said light source to said one side of said light source.

31. A lighting fixture comprising a light source, a reflecting system for said light source shaped and arranged to concentrate light in a predetermined angular range measured from downward vertical and provide progressively decreasing intensity of projected light with changes in the angle of projection from said range to downward vertical, said reflector system comprising a first reflector generally frustoconical in shape concentric about a vertical axis passing through said source having an inner reflecting surface and an outer reflecting surface, a second reflector having a generally frustoconical inner reflecting surface concentric about said vertical axis positioned above said first reflector in a nested relationship with respect to said first reflector whereby the lower edge of the reflecting surface of said second reflector is below the upper edge of the outer reflecting surface of said first reflector, said first and second reflectors being shaped and arranged so that light radiated horizontally from said source is reflected by said inner reflecting surface of said first reflector and light radiated from said source is reflected by the reflecting surface of said second reflector to the outer reflecting surface of said first reflector to be re-reflected in said predetermined angular range from downward vertical.

32. A lighting fixture as recited in claim 31, wherein the inner reflecting surfaces of said first and second reflectors are concave in axial section.

33. A lighting fixture as recited in claim 31, wherein said reflecting system further comprises means positioned adjacent to the upper end of said first reflector extending inwardly therefrom to block light which otherwise would be radiated from said source to between said first and second reflectors and be projected from the fixture at greater than a predetermined cutoff angle from downward vertical, said cutoff angle being above said predetermined angular range and being less than 90 degrees.

34. A lighting fixture as recited in claim 33, wherein said means to block light, which otherwise would be radiated from said source to between said first and second reflectors comprises a ring extending horizontally inward from the top of said inner reflecting surface of said first reflector.

35. A lighting fixture as recited in claim 31, wherein said reflecting system further comprises a third reflector generally frustoconical in shape concentric about said vertical axis positioned below said first reflector, said third reflector having an outer reflecting surface facing upwardly and outwardly and an inner reflecting surface, and a fourth reflector having a reflecting surface shaped as a surface of revolution positioned within said third reflector and concentric about said vertical axis, said outer reflecting surface of said third reflector and said inner reflecting surface of said first reflector being shaped and arranged so that light radiated from said source is reflected by the inner reflecting surface of said first reflector to the outer reflecting surface of said third reflector and re-reflected in said predetermined angular range, said inner reflecting surface of said third reflector and the reflecting surface of said fourth reflector being shaped and arranged so that light radiated from said source is reflected by the inner reflecting surface of said third reflector to the reflecting surface of said fourth reflector and then re-reflected in a second angular range from downward vertical below said first mentioned predetermined angular range.

36. A lighting fixture as recited in claim 31, wherein said reflecting system further includes a third reflector defining a reflecting surface generally frustoconical in shape concentric about said vertical axis and positioned above said second reflector, the reflecting surface of said third reflector facing downwardly and outwardly and being shaped and arranged so that light radiated from said source at angles to pass above the reflecting surface of said second reflector is reflected by the reflecting surface of said third reflector into said predetermined angular range from downward vertical.

37. A lighting fixture comprising a light source, a plurality of annular reflectors having a common vertical axis passing through said light source, at least three vertically extending rods distributed around said light source, and means for mounting said reflectors on said rods.

38. A lighting fixture as recited in claim 37, further comprising a cover extending over said light source and said reflectors and a light transmitting enclosure extending from the edge of said cover to beneath said annular reflectors to enclose said light source and said reflectors within said cover and said enclosure, and means for supporting said cover on said rods.

39. A lighting fixture as recited in claim 37, wherein said reflectors are formed into horizontal rings at the inner edges thereof and wherein said means to mount said reflectors on said rods comprises means securing said rings to said rods.

40. A lighting fixture comprising a light source, a reflector system surrounding said light source comprising means to cut off projected light above a predetermined cutoff angle from downward vertical and to project light with a maximum intensity in a range near said cutoff angle with the intensity decreasing progressively preceeding from said range toward downward vertical, a light transmitting enclosure surrounding said light source and said reflector system, said enclosure having a vertically extending wall surrounding said light source and said reflector system, said vertically extending wall having vertically extending ribs defined in at least one surface thereof, said ribs comprising means to diffuse the light horizontally but not vertically.

* * * * *